United States Patent [19]

Horie

[11] Patent Number: 4,629,429

[45] Date of Patent: Dec. 16, 1986

[54] ABACUS WITH EACH COUNTER HELD IN POSITION BY FRICTION OR MAGNETIC ATTRACTION

[76] Inventor: Tsuyoshi Horie, 7-15, Iwamoto-cho 3-chome,, Chiyoda-ku, Tokyo, Japan

[21] Appl. No.: 787,675

[22] Filed: Oct. 15, 1985

[51] Int. Cl.[4] ..... G06C 1/00

[52] U.S. Cl. ..... 434/203

[58] Field of Search ..... 434/203, 204

[56] References Cited

U.S. PATENT DOCUMENTS

| | | | |
|---|---|---|---|
| 2,527,080 | 10/1950 | Rickard et al. | 434/203 |
| 2,872,742 | 2/1959 | Schott | 434/203 |
| 3,387,392 | 6/1968 | Kurz | 434/203 |
| 3,508,348 | 4/1970 | Harada | 434/203 |

*Primary Examiner*—William H. Grieb

*Attorney, Agent, or Firm*—Cushman, Darby & Cushman

[57] ABSTRACT

An abacus for performing calculations by sliding counters along partition walls extending vertically. Each counter has a spherical or beadlike head protruding above the body of the abacus, as well as a stem. Shafts extend horizontally through the partition walls and also through the stems of the counters. A hole is formed in each stem of the counters and horizontally extends partially through the stem. A compressed spring is mounted in each hole, and a small ball is attached to the front end of the spring. The side surface of each counter which is not in contact with the ball is pressed against the opposed partition wall by the action of the spring. Thus, the counters are maintained at their present positions even in a moving vehicle.

2 Claims, 4 Drawing Figures

ABACUS WITH EACH COUNTER HELD IN POSITION BY FRICTION OR MAGNETIC ATTRACTION

FIELD OF THE INVENTION

The present invention relates to an abacus for performing calculations by sliding counters along vertical partition walls. More specifically, it relates to an abacus that can be used even in a moving vehicle.

SUMMARY OF THE INVENTION

It is an object of the present invention to provide an abacus which can be used even in a rocking vehicle.

It is a more specific object of the invention to provide an abacus whose counters are not inadvertently moved even if the abacus is vertically hung or it is rocked in a moving vehicle, whereby the abacus can be employed in such a moving vehicle.

It is a further object of the invention to provide an abacus best suited for the blind.

These objects are achieved by an abacus consisting of a frame holding vertical partition walls between which a specific number of counters can be slided, the counter slided to the opposite position from the original null position representing a digit or a specific number of digits, the abacus being characterized by the provision of compressed springs that act to hold counters at their present positions.

Other objects and features of the invention will appear in the course of the description thereof which follows.

DETAILED DESCRIPTION OF THE INVENTION

Figure 1:
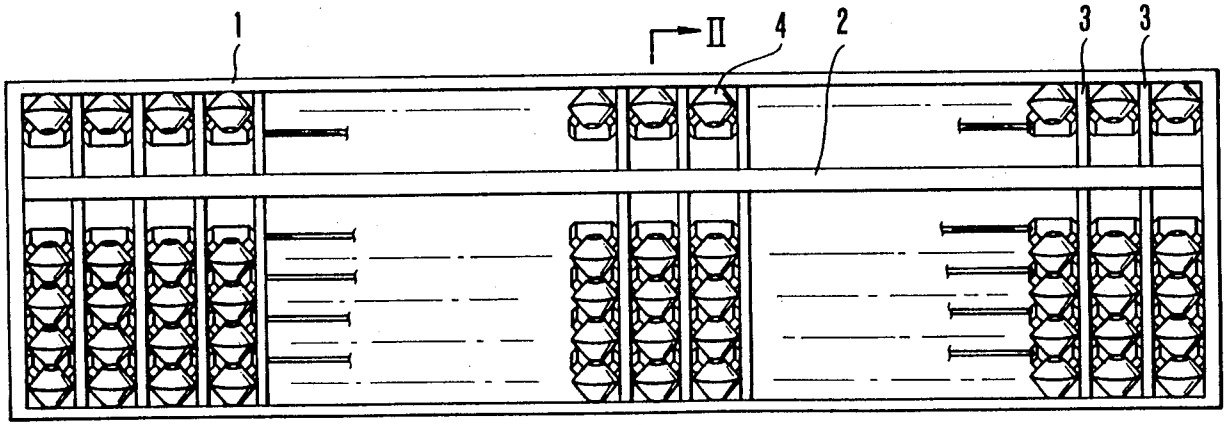
FIG. 1 is a front elevation of an abacus according to the present invention under the condition in which all the counters are set at their null positions in preparation for a calculation.

Referring to FIG. 1, there is shown an abacus embodying the concept of the present invention. This abacus consists of a frame 1, a beam 2 extending horizontally, partition walls 3, counters 4, and compressed springs 6 (FIG. 3).

Figure 2:
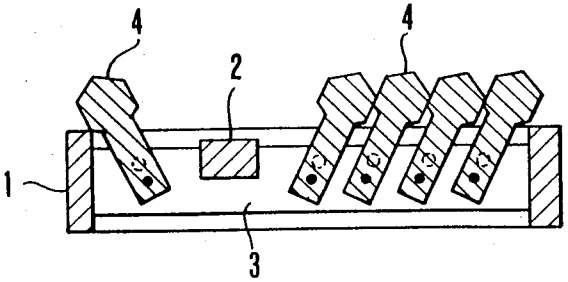
FIG. 2 is an enlarged cross section taken on line II—II of FIG. 1.
Figure 3:
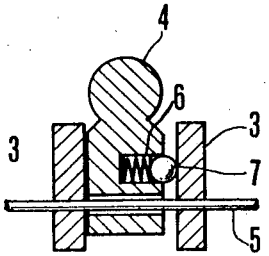
FIG. 3 is an enlarged vertical cross section of main portions of the abacus shown in FIG. 1.

As can be seen from FIGS. 2 and 3, each counter 4 is shaped like a doll and has a beadlike head protruding above the body of the abacus. Shafts 5 extend horizontally through the walls 3 and also through holes formed in each stem of the counters 4. Thus, the counters 4 are pivotally mounted to the shafts 5. Each spring 6 is mounted in a hole formed in the stem of each counter 4, the hole horizontally extending partially through the stem. A small ball 7 is mounted to the front end of each spring 6. Each counter 4 is pressed against the wall 3 that is not in contact with the ball 7, by the biasing force of the spring 6.

When the head of one counter 4 of the abacus constructed as described above is raised with a fingertip, the counter 4 rotates about the shaft 5 to which it is mounted until it bears on the beam 2. Thus, the counter represents a digit. Then, the counter 4 is kept in that position, because it is pressed against the wall 3 that is not in contact with the ball 7 by the action of the compressed spring 6 as mentioned previously. Consequently, even if the abacus is rocked while it is in use, the counters will not be moved. Hence, wrong calculations due to rock will not take place. Further, since the heads of the counters 4 protrude and are arranged above the body of the abacus, they can be slid with fingertips for performing calculations in the same manner as the conventional abacus. In addition, all the counters 4 can be rapidly set at their null positions in preparation for a new calculation by sweeping a fingertip along the beam 2, because the counters 4 are disposed in side-by-side relation.

Furthermore, as the positions of counters are held by the biasing force of the springs, even the blind can use the abacus. When the abacus is carried, even if it is used in a rocking vehicle, counters are not inadvertantly moved. Hence, incorrect calculations are prevented. Also, the abacus can be hung on a wall so that it may be used for teaching abacus. In this way, the abacus yields various practical advantages.

Figure 4:
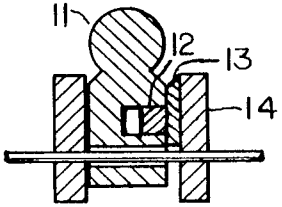
FIG. 4 is an enlarged vertical cross section of main portions of the abacus of a second embodiment.

Although the compressed spring shown in FIG. 3 takes the form of a coil, the spring used in the abacus according to the invention is not limited to this form. Also, the spring and the small ball may be replaced by a permanent magnet 12 embedded horizontally in each counter 11 and a sheet of iron 13 mounted in the opposite partition wall 14 as shown in FIG. 4 Further, counters may also be employed each of which is equipped with neither the assembly of a spring and a small ball nor the combination of a permanent magnet and a sheet of iron, in which case it is more difficult to maintain the counters in position when the abacus is rocked.

What is claimed is:

1. An abacus comprising:

vertically extending partition walls along which a specific number of counters can be slid, each counter representing a digit or a specific number of digits, each counter being shaped like a doll having a spherical head and a stem, the head protruding above the body of the abacus;

shafts extending horizontally through the partition walls and also through the stems of the counters such that the counters are pivotally mounted to the shafts in side-by-side relation to each other;

compressed springs each mounted in a hole formed in each stem of the counters, the hole horizontally extending partially through the stem; and small balls attached to the springs;

whereby the side portion of each counter that is not in contact with the small ball is pressed against the opposed partition wall by the biasing force of the springs to maintain the counters at their present positions.

2. An abacus comprising:

vertically extending partition walls along which a specific number of counters can be slid, each counter representing a digit or a specific number of digits, each counter being shaped like a doll having a spherical head and a stem, the head protruding above the body of the abacus;

shafts extending horizontally through the partition walls and also through the stems of the counters such that the counters are pivotally mounted to the shafts in side-by-side relation to each other;

pieces of permanent magnet each embedded in a hole formed in the stem of each counter, the hole horizontally extending partially through the stem; and iron sheets mounted on the partition walls opposite to the magnet pieces;

whereby the counters are maintained at their present positions by the magnetic force of the magnet pieces.

* * * * *